US006820581B2

(12) United States Patent
Vene

(10) Patent No.: US 6,820,581 B2
(45) Date of Patent: Nov. 23, 2004

(54) VALVE LIFTER

(75) Inventor: Richard Vene, Strongsville, OH (US)

(73) Assignee: Morel Motorsports, Inc., Cleveland, OH (US)

( * ) Notice: Subject to any disclaimer, the term of this patent is extended or adjusted under 35 U.S.C. 154(b) by 30 days.

(21) Appl. No.: 10/324,175

(22) Filed: Dec. 18, 2002

(65) Prior Publication Data

US 2003/0145818 A1 Aug. 7, 2003

Related U.S. Application Data

(60) Provisional application No. 60/355,719, filed on Feb. 7, 2002.

(51) Int. Cl.[7] ..... F01L 1/14
(52) U.S. Cl. ..... 123/90.48; 123/90.35
(58) Field of Search ..... 123/90.48, 90.5, 123/90.35

(56) References Cited

U.S. PATENT DOCUMENTS 5,022,356 A 6/1991 Morel, Jr. et al.
5,127,374 A 7/1992 Morel, Jr. et al.
5,178,107 A 1/1993 Morel, Jr. et al.
6,328,009 B1 * 12/2001 Brothers ..... 123/90.35

* cited by examiner

*Primary Examiner*—Thomas Denion
*Assistant Examiner*—Zelalem Eshete
(74) *Attorney, Agent, or Firm*—Watts Hoffmann Co.

(57) ABSTRACT

The present invention is related to a valve lifter for use in an internal combustion engine. The valve lifter comprises a body adapted to be reciprocally slidable within a valve lifter bore of an engine. The valve lifter includes a rotably mounted cam roller engaging the cam lobe of a cam-shaft where the cam lobe operates to drive the valve lifter body towards a valve open position. The valve lifter may also include an auxiliary roller rotatably mounted in the valve lifter body and engaging the cam roller where the force from the cam lobe is transferred to the lifter body through both the cam roller and auxiliary roller. The present invention includes a method of making a valve lifter by creating grooves in the walls of the recess to aid in the lubrication of the rollers.

14 Claims, 4 Drawing Sheets

VALVE LIFTER

RELATED APPLICATION

The present application is a non-provisional application claiming the benefit of U.S. Provisional Application, Serial No. 60/355,719 entitled VALVE LIFTER, filed in the United States Patent and Trademark Office on Feb. 7, 2002.

FIELD OF THE INVENTION

The present invention relates to high performance racing engines and more particularly, to an improved valve lifter for such racing engines.

BACKGROUND OF THE INVENTION

Conventional camshaft internal combustion engines typically utilize valve lifters, push rods and valve springs along with rocker arms to open and close the valves of the engine to allow air and fuel to enter and exhaust to exit the cylinders of the engine during combustion. The valve lifter with a pushrod includes a cam roller, which rides on the lobes of a camshaft, which is rotated by the crankshaft. In typical roller type valve lifters, the force generated as the cam lobe drives the roller and associate valve lifter body to its valve opening position, is transferred to the valve lifter body through a pin that mounts the roller to the valve lifter body. The entire force imparted on the lifter body during reciprocation of the valve lifter is borne by the bearing and associated pin. As the lifter reciprocates up and down, the push rod seated in the lifter also reciprocates and transfers this up and down motion via a rocker arm to either an intake or exhaust valve.

During the up stroke of the piston in the cylinder, the intake valve opens to allow fuel and air to enter the combustion chamber. Somewhere near the very top of the up stroke, both the intake and the exhaust valves close and the spark plug creates a spark to ignite the air-fuel mixture which is under compression by the piston. This results in a high temperature explosion which forces the piston downward, called the "power stroke," thereby translating this movement via a connection rod to rotate the crankshaft which, in turn, translates this angular motion to the wheels of the vehicle via a set of gears. Near the bottom of the compression stroke, the exhaust valve opens to expel the burnt fuel mixture out of the cylinder. After the piston changes directions and begins the up stroke, the exhaust valve continues to remain open thereby forcing any remaining the spent gases out of the cylinder. However, during this same time, the intake valve begins to open to recharge the cylinder with fuel. It is not until the piston has started to travel upward that the exhaust valve closes. Thus, at various times during the compression cycle, both the intake and exhaust valves will be open and closed at the same time. The timing of the opening and closing of the valves is controlled by the physical design of the oval shaped lobes on the camshaft. As the valve lifter is pushed upward by the lobe of the camshaft, the valve lifter pushes the pushrod up which drives the rocker arm downward, causing the valve to open. Likewise, as the lifter and pushrod travel downward, the rocker arm raises and the valve closes due to the biasing action of the valve spring.

In the operation of high-speed engines, measured as revolutions per minute (RPM), the valve train components are under extreme stress and high temperatures. This causes high frictional forces to be imparted on the cam roller via the cam lobe of the camshaft. Overall cam roller wear is a function of engine speed. High performance engines such as those used in drag racing applications produce extremely high engine speeds (6,000 to 13,000 RPM) over a short duration of time (i.e. less than 5 to 12 seconds). At these high engine speeds, it becomes difficult for the cam roller, pin and the associated bearings to withstand the stress of the engine and, therefore, subsequently fail. Cam rollers and associated pin often fail prematurely in racing situations due to this excessive force causing the valve lifter to be replaced between successive races. Therefore, there is a need for a valve lifter design that can withstand the stress of high performance engines used under racing conditions.

In addition, inadequate oiling of the bearings will also result in excessive wear and may lead to failure of the bearings, and consequently failure of the valve lifter. A known approach to oiling the bearings is to provide oil feed bevels in the body of the valve lifter that houses the roller. This oil feed bevel allows oil to flow into the distal end of the valve lifter towards the shaft and bearings. While this method attempts to provide oil to the cam roller bearing, oil may not be present in this area or may be directed away from the shaft and bearing due to the rotation of the cam. Therefore, there is a need for a valve lifter design which improves the oiling of the cam roller bearings to prevent premature failure of the cam roller, especially in racing engines where high RPMs are obtained.

SUMMARY OF THE INVENTION

The present invention relates to a valve lifter for an internal combustion engine, particularly for use in high performance in racing applications. The valve lifter includes a body adapted to be reciprocally slidable within a valve lifter bore forming part of the engine. The valve lifter also includes a cam roller and an auxiliary roller rotatably mounted in the lifter body. The cam roller engages the cam lobe of the cam-shaft for driving valve lifter body to open the associated valve. The auxiliary roller is mounted in the lifter body and engages the cam roller is such manner that the force of the cam lobe on the cam roller is transferred to both the cam roller and auxiliary roller such that neither roller bares the total force of the cam lobe individually.

In a preferred embodiment, the cam roller and auxiliary roller are secured in the lifter body by pins. These pins allow the force from the cam lobe to be transferred from the rollers to the valve lifter body to open the associated valve.

In another embodiment of the present invention, the valve lifter body includes a recess to house the cam roller. This recess includes grooves in the walls of the recess to allow oil to be directed into the recess. Oil is needed in this area of the lifter body to lubricate the bearings of the cam roller. In addition, an auxiliary roller can be included in the upper portion of the recess. The auxiliary roller is in rolling engagement with the cam roller. The grooves in the recess wall allow oil to be introduced to the upper region of the recess, which, in turn, allows the bearings of the auxiliary roller to be lubricated. This lubrication feature increases the life of the valve lifter.

The present invention is also directed to a method of milling the recess of a valve lifter such that grooves remain on the walls of the recess for lubricating the bearings of the rollers. The method involves drilling holes in the body of the lifter where the recess is to be formed. A milling cutter is used to create the recess. The milling cutter does not mill to the outer edges of the holes, thus, upon completion grooves will remain at the four corners of the recess.

DETAILED DESCRIPTION

Figure 1:
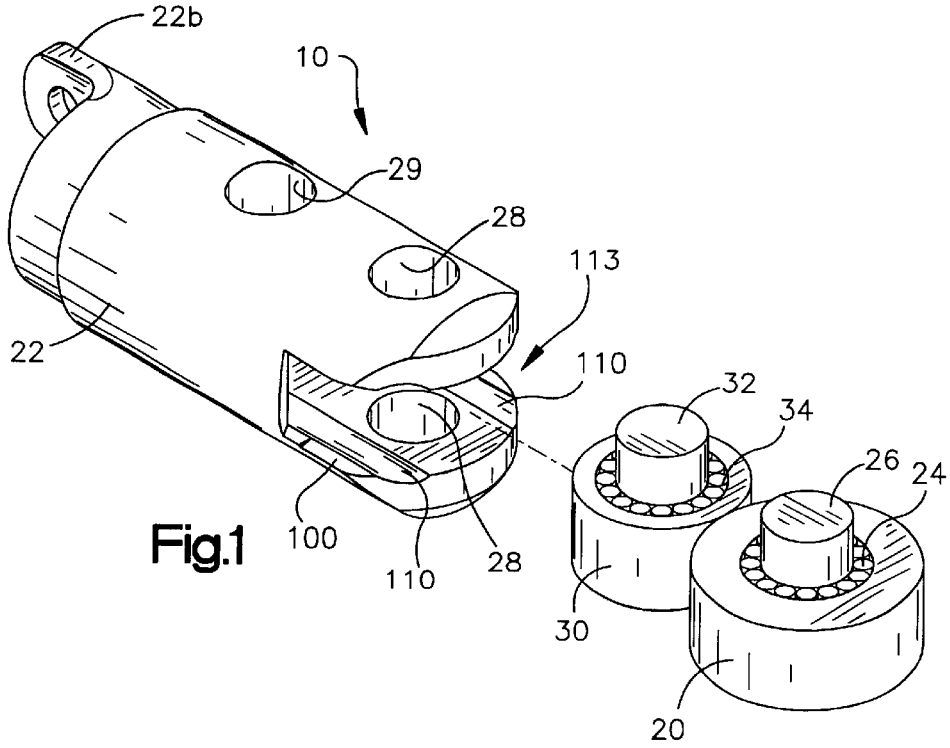
FIG. 1 is a perspective view of a valve lifter constructed in accordance with the preferred embodiment of the present invention.
Figure 2:
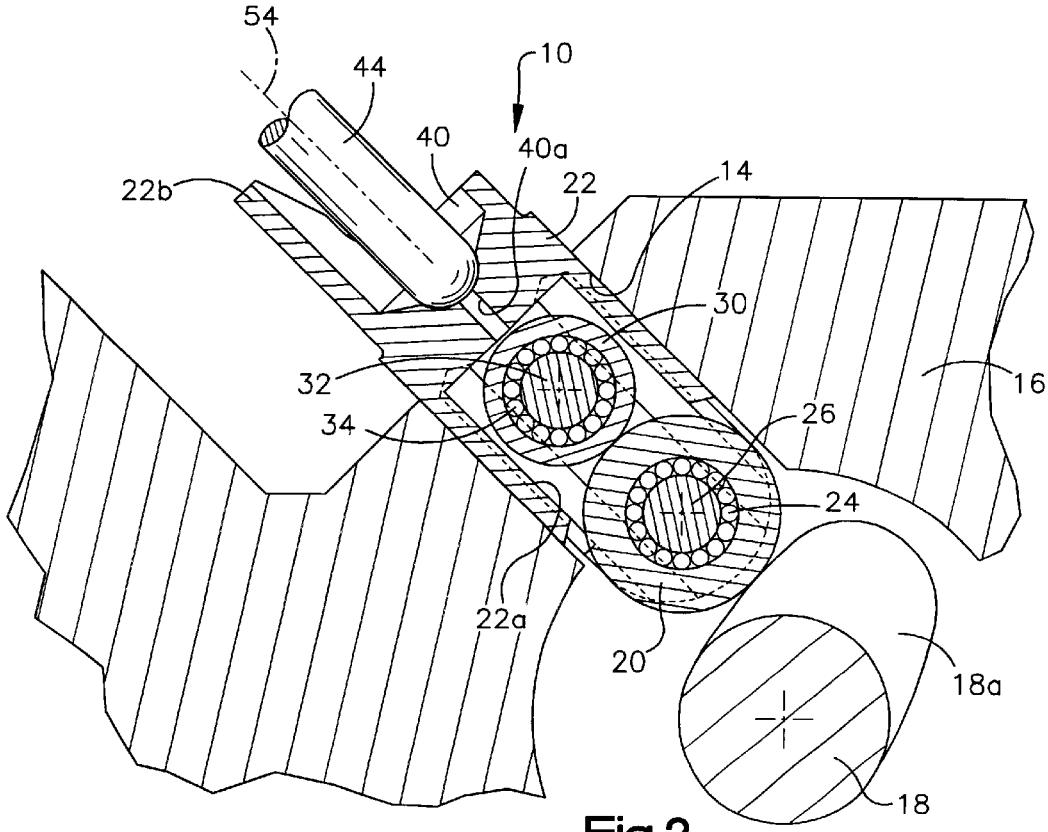
FIG. 2 is a fragmentary view, partially in section of a valve lifter constructed in accordance with the preferred embodiment of the invention shown in an operative position within an engine.

FIGS. 1 and 2 illustrate the overall construction and use of a valve lifter 10 constructed in accordance with the preferred embodiment in the invention. The disclosed valve lifter 10 is especially suited for engine applications where high forces are encountered in opening the intake and exhaust valves. In particular, the disclosed valve lifter is especially useful in an overhead valve engine of the type that utilizes push rods for opening poppet-type intake and exhaust valves and valve springs for returning the valves to their closed positions. Generally the high forces referred to are encountered in competition engines used in drag racing and in particular to engines used in "top fueler competitions". These engines utilize special fuels and superchargers to generate substantial horsepower for short intervals of time whereby vehicles are propelled from a stand still to speeds in excess of 300 mph in four or five seconds.

As seen in FIGS. 1 and 2, the valve lifter 10 is mounted for reciprocating movement in a bore 14, which is typically defined by an engine block 16. As is conventional, the valve lifter 10 is driven generally upwardly to its valve opening position by a cam lobe 18*a*, which forms part of a conventional cam shaft 18. The valve lifter is urged downwardly, i.e., towards the cam shaft by valve springs (not shown) associated with each valve (not shown) which return the intake and exhaust valves to their closed positions.

Each valve lifter 10 includes a cam roller 20 rotatably mounted at least partially within a valve lifter body 22. Preferably, a set of needle bearing 24 rotatably supports the cam roller 20 on a fixed shaft 26 having ends secured in bores 28 forming part of the valve lifter body 22. Optionally, the valve lifter 10 may incorporate an auxiliary roller 30 also positioned within recess 22*a*.

As seen best in FIG. 2, the cam roller 20 rides on an associated cam lobe 18*a* and the illustrated lifter 10 would be considered a "roller" type lifter. In conventional roller lifters, the force generated as the cam lobe drives the roller and associated valve lifter body to its valve opening position, is transferred to the valve lifter body through the pin that mounts the roller to the valve lifter body. The entire force is therefore borne by the bearing and associated pin.

According to the invention, the valve opening force generated by the cam is partially transferred to the valve lifter body 22 by an auxiliary roller 30 which is also rotatably connected to the valve lifter body 22 by an associated pin 32 and needle bearing 34. The pin 32 is rotatably held in associated bores 29 formed in the lifter body 22. Again as seen best in FIG. 2, the auxiliary roller 30 is an operative contact and in rolling engagement with the cam roller 20. As a result, the valve opening force generated cam lobe 18*a* as it drives the valve lifter 10 towards the valve opening position, is jointly transferred to the valve lifter body 22 by the roller pins 26, 32. As a result, the valve opening force is distributed between the pins 26, 32 and no one pin or associated needle bearing bears all of the load.

The proportion of the total valve opening force which is borne by the pins 26, 32 is determined in some part by the relative size of the rollers and the positioning of the roller support pins 26, 32.

The valve lifter body 22 includes a recess 22*a* in which the auxiliary roller 30 and a portion of the cam roller 20 are located. As is conventional, the upper part of the valve lifter body 22 includes a socket 40 for receiving the lower end of a push rod 44. The socket 40 includes a relatively small bore 40*a* by which oil is conveyed to the socket 40 for providing lubrication to the associated rod 44. In some designs, the push rods include a longitudinal oiling passage by which oil is delivered to the valve train (i.e. rocket shaft, rocker arm, and valve stems) located in the head of the engine.

The disclosed valve lifter body 22 also includes an ear 22*b* to which a conventional anti-rotation bar (not shown) is attached. In general, an anti-rotation bar is attached to the ears of adjacent valve lifter and prevent the valve lifters from rotating within their associated bore and ensure that the cam roller 20 remains aligned with the cam lobe 18*a*.

Figure 3:
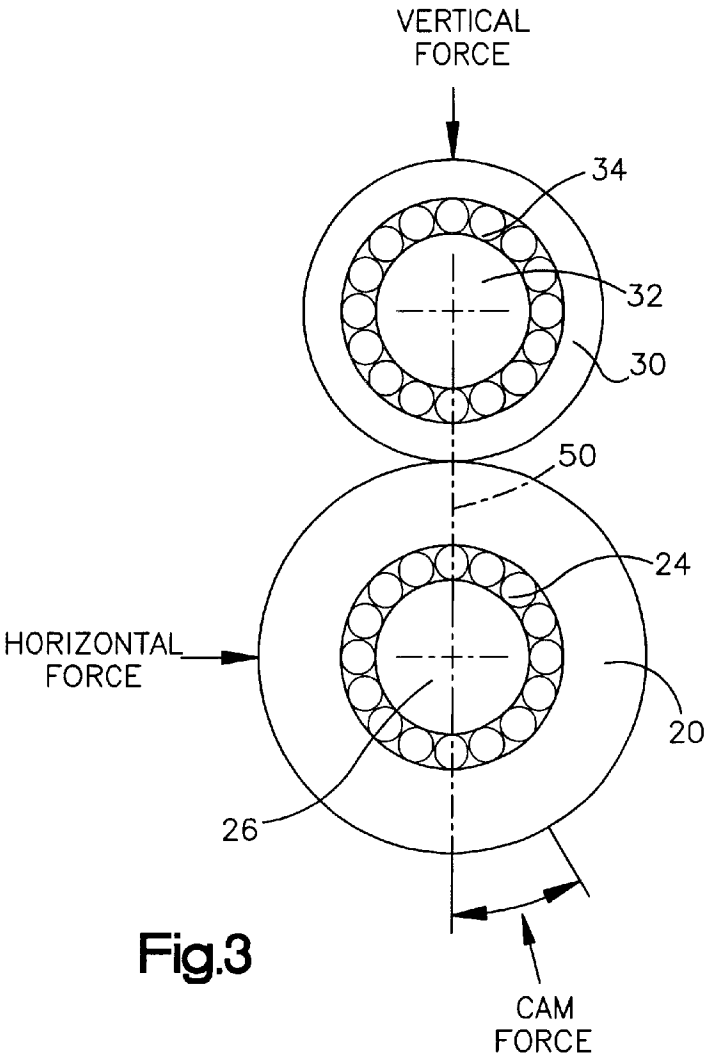
FIG. 3 illustrates the positioning of, and force transfer between, rollers forming part of the valve lifter shown in FIG. 1.

FIG. 3 illustrates the relationship between the cam and auxiliary rollers 20, 30 and the cam force. In general, the cam lobe 18*a* contacts the cam roller 20 at a point on the cam roller 20 that is offset with respect to a center line 50 going through the centers of the shafts 26, 32. As a result, the force exerted on the roller 20 by the cam lobe 18*a* has both a vertical and horizontal component (as viewed in FIG. 3). In other words, the vector of the force exerted on the cam roller 20 by the cam lobe 18*a* is not aligned with the longitudinal axis of the push rod 44 (see FIG. 2).

Figure 4:
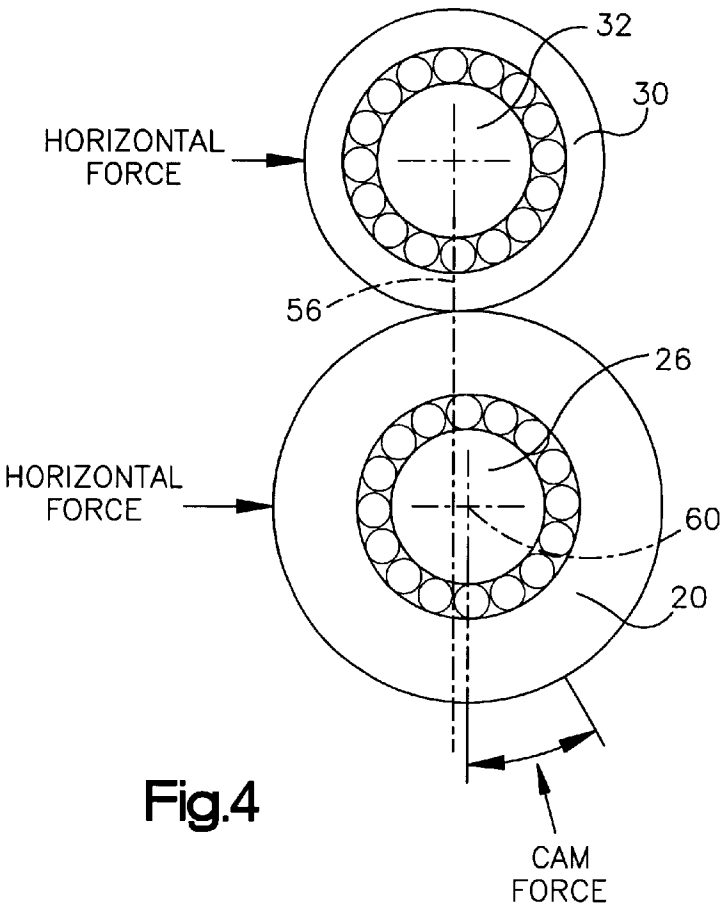
FIG. 4 shows an alternate positioning for the rollers shown in FIG. 3.

FIG. 4 illustrates an alternate positioning of the rollers within the valve lifter body to at least partially compensate for the horizontal component of the valve opening force. In the FIG. 4 arrangement, a center line 56 for the auxiliary roller 30 is offset with respect to the center line 54 defined by the longitudinal axis of the push rod 44 and rotational center of the cam roller 20. By offsetting the auxiliary roller 30, some of the horizontal force is transferred to the auxiliary roller 30 and as a result, both the vertical and horizontal components of the valve opening force are shared i.e. split between the pins 26, 32.

Figure 5:
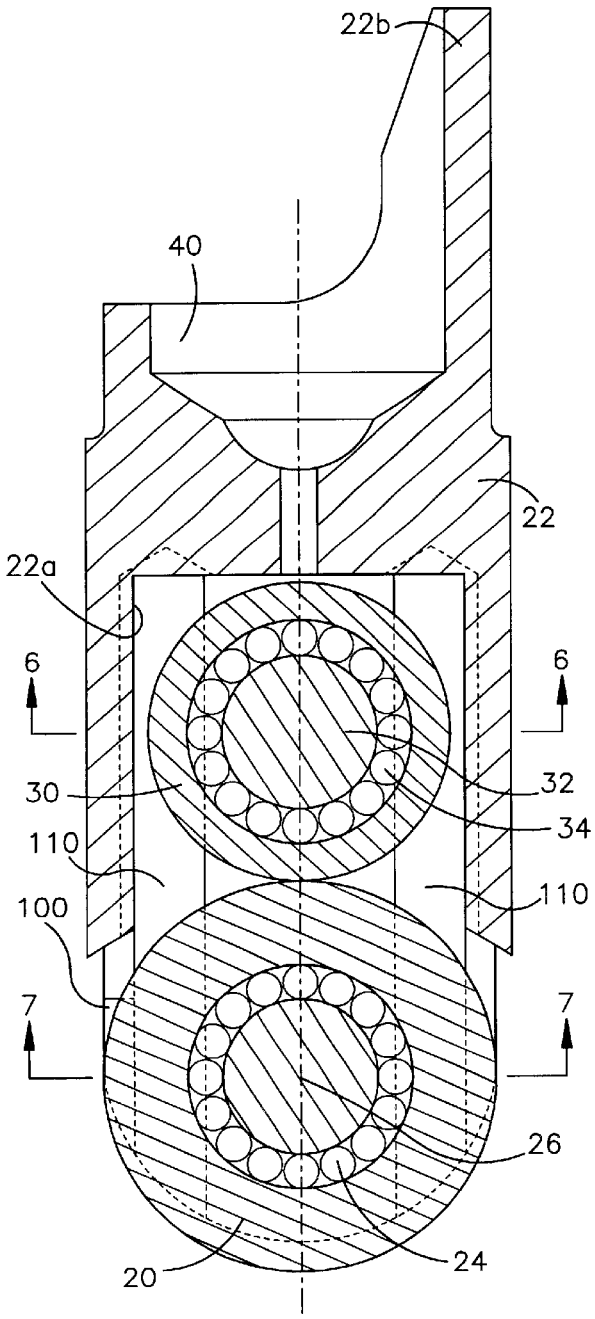
FIG. 5 is a cross-sectional view of the valve lifter shown in FIG. 1, with the cam roller and auxiliary roller in their perspective positions.
Figure 6:
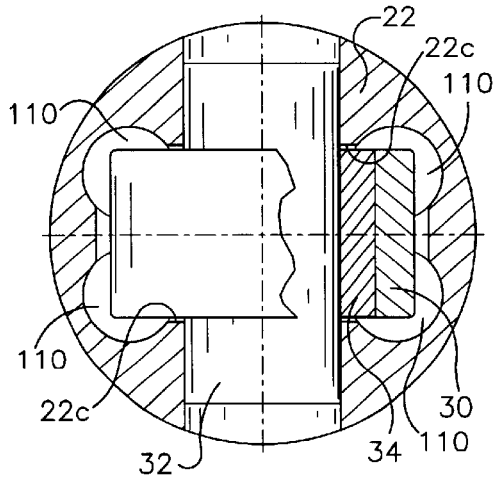
FIG. 6 is a cross-sectional view of the lifter body of FIG. 1, taken along line 6—6 of FIG. 5 with the auxiliary roller in the elevated position.
Figure 7:
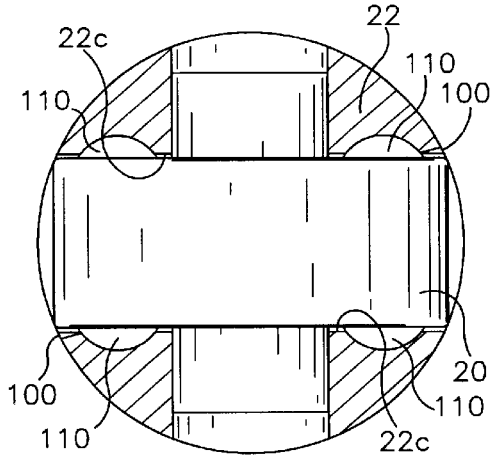
FIG. 7 is a cross-sectional view of the lifter body of FIG. 1, taken along line 7—7 of FIG. 5 with the cam roller in the elevated position.

FIGS. 5–9 illustrate the design of the lifter body in accordance with the present invention. As is conventional, the lifter body 22 contains a bevel 100 to allow oil to enter the lifter body 22 upon reciprocation. When the valve lifter is in motion, oil is splashed into the lifter, which in turns saturates the cam roller 20 with oil, thereby, oiling the set of needle bearings 24. According to the present invention, in a preferred embodiment, grooves 110 are cut for the entire length of walls of the recess 22*a*. The grooves 110 facilitate the introduction of oil into the recess 22*a*. When the auxiliary roller is present, as shown in FIG. 5, the grooves 110 help introduce oil to the bearings 34 of the auxiliary roller 30. This is best shown in FIGS. 6 and 7.

The cam roller 20 and auxiliary roller 30 each contain a set of needle bearings 24 and 34, respectively. The cross-sectional view of FIG. 5 illustrates the positions of the individual bearings when exposed to the grooves 110. At any given time, two portions of each side of the set of bearings 24 and 34 in the cam roller 20 and the auxiliary roller 30 are exposed to the grooves 110. These portions occur at opposite position of the same side of the rollers where the grooves are cut in the recess walls 22*c*. As shown in FIGS. 6 and 7, recess walls 22*c* cover a portion of the set of bearings 24 and 34 while the uncovered portion is exposed to the grooves 110. Preferably, in the completely exposed position, half of an individual bearing is covered by the recess walls 22*c* and half of the bearing is exposed to the groove 110. Exposure to the grooves 110 occurs at only specific points within the recess 22*a*. For example, individual bearings located in the 12 and 6 o'clock positions of the auxiliary roller 30 and/or the cam roller 20 of FIG. 5 are covered by the recess walls 22*c* on both sides. When these two individual bearings are rotated to approximately either the 3 or 9 o'clock positions, they are partially covered by the recess walls 22*c* and partially exposed to the grooves 110. The set of bearings can contain either an even or odd number of individual bearings. In the case where there are an odd number of bearings, when a bearing occupies the 3 o'clock position, the corresponding 9 o'clock position is occupied by a section of two consecutive bearings and the interstitial space between them.

When the valve lifter is in motion, the cam roller 20 and auxiliary roller, if present, rotates within the recess 22*a*. This rotation, consequently, allows each of the individual bearings to be exposed to the grooves 110 and thus lubricated.

FIG. 6 illustrates a sectional view of the lifter body 22 as shown from line 6—6 of FIG. 5, wherein the auxiliary roller 30 is shown half in elevation and half in a cut-away view. In the preferred embodiment, the grooves 110 are created for the entire length of the recess 22*a*. The grooves 110 are created so that there is enough of the recess walls 22*c* between the grooves 110 such that needle bearings 24 and 34 of the auxiliary roller 30 or cam roller 20 in FIG. 7 remain in contact with the recess walls 22*c*, thereby, securing the bearings in their relative positions. In a preferred embodiment, a portion of the set of the needle bearings 24 of the cam roller 20 and the needle bearings 34 of the auxiliary roller 30, if present, are partially exposed in the grooves 110, as described above. During normal engine operation, oil enters the lifter body 22 through the bevel 100 and travels in the grooves 110 thereby lubricating the roller cam 20. When an auxiliary roller 30 is present, oil is moved up the grooves 110, the entire length of the recess 22*a* to the auxiliary cam 30, thus supplying the necessary lubrication to the needle bearings 34 of the auxiliary cam 30.

FIG. 7 illustrates a sectional view of the lifter body 22 as shown from line 7—7 of FIG. 5, wherein the roller cam 20 is elevated. The channels 110 are shown along with the bevel 100. In a preferred embodiment, two bevels 100 are cut in the lifter body 22 each at opposite corners of the recess 22*a*. The two bevels 100 ensure that oil is introduced to the inside of the lifter body 22 without regard to the direction of the roller cam 20 or auxiliary cam's 30 rotation. Once oil is present in the inside of the lifter body 22, it can be introduced to the needle bearings 34 of the auxiliary roller 30 via grooves 110. In addition, the valve lifter according to FIG. 7 can also be constructed to not include the auxiliary roller 30. In this embodiment, the grooves 110 increase the introduction of oil to the bearings 24 of the cam roller 20.

Figure 8:
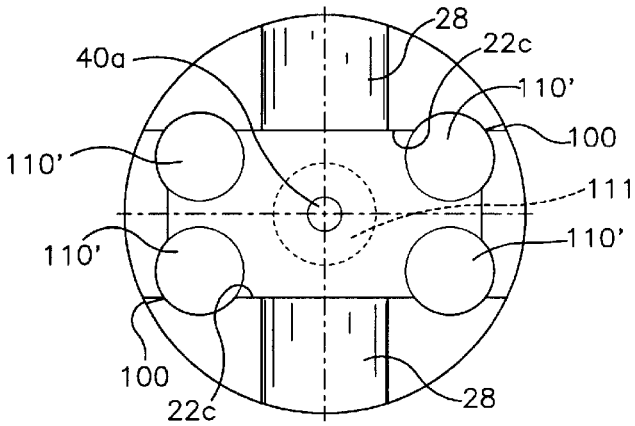
FIG. 8 is an end view of a lifter body blank illustrating certain machining steps that are used to form the lifter body.

FIG. 8 is an end view of a cylindrical blank or bar segment that is ultimately machined into the lifter body 22 shown in the other Figures. According to the present invention, the recess 22*a* can be created in any manner in which grooves are left in the walls of the recess 22*a*. In the preferred embodiment, holes 110' are drilled at the four corners of the recess 22*a*.

More specifically, the machining steps that may be performed in order to create the recess 22*a* (including sidewalls 22*c*) and the oiling grooves 110 are as follows. Four longitudinal bores 110' are drilled into the cylindrical blank or bar. A drill or end mill is then used to drill a cylindrical bore 111 centrally with respect to the bores 110'. The bore 111, as seen in FIG. 8, is substantially larger than the bores 110' and is preferably slightly less than the spacing between opposite side walls 22*c*. As an example, the bores 110' may be 7/32 inches and the bore 111 may be 0.375 inches If an end mill is used to drill the bore 111, it can then be moved laterally in order to mill out the rectangular recess 22*a*. The milling bit mills the center stock of the recess 22*a*; the bit does not mill to the complete outer edge of the four corner holes 110'. Since the milling cutter only cuts through a portion of the bores 110', the oiling grooves 110 are thus formed.

This machining operation produces a recess 22*a* with straight sides 22*c* and small radial corners. It has been found that the holes 110' produce grooves 110 that advantageously introduce lubrication to the needle bearings 24 of the cam roller 20 and needle bearing 34 of the auxiliary cam 30. The resulting valve lifter body 22 with the recess 22*a* and grooves 110 can be used with either a cam roller or with a cam roller and auxiliary roller. It should be noted that if the bore 111 is machined with a drill, a milling cutter would then be introduced into the bore 111 to perform the milling operation. The same or a different milling cutter may be used to form a slot 113 (see FIG. 1) in which the roller 20 is positioned. As part of the step of milling the slot 113, the bevels 100 may also be machined.

Figure 9:
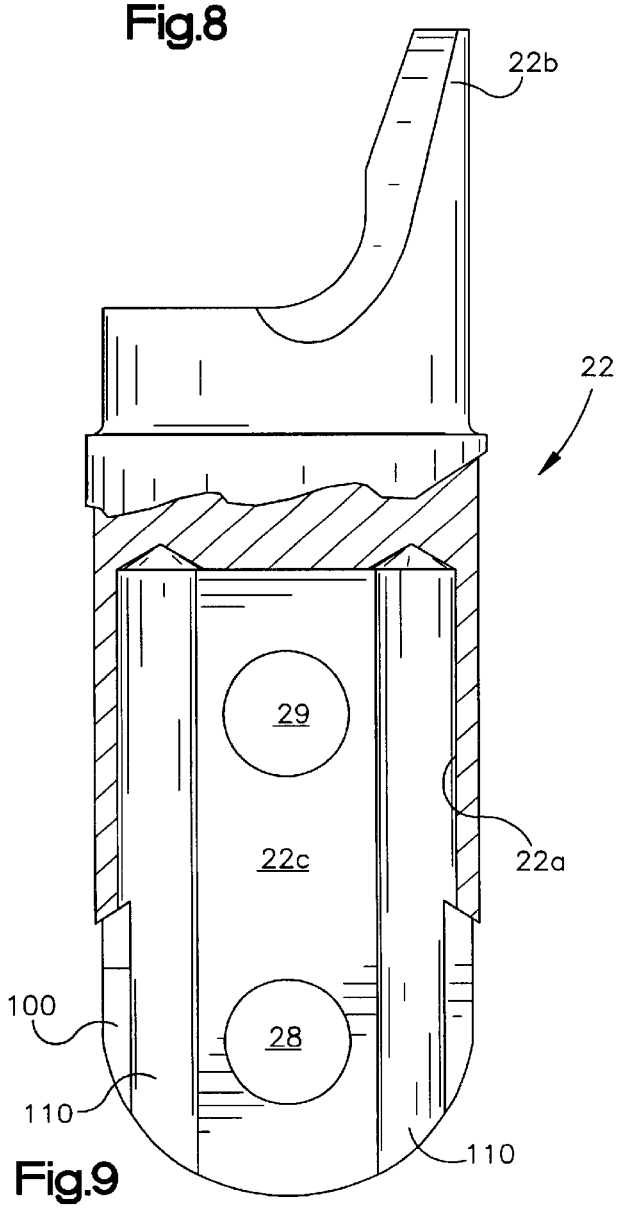
FIG. 9 is a cutaway view, partially in cross-section of the lifter body shown in FIG. 5, with the cam roller and auxiliary roller removed.

FIG. 9 is a cutaway view of the lifter body 22 showing another view of the channels 110 in relation to the recess 22*a*. Also shown are the bevel 100 and bores 28. The channels 110 preferably run the entire length of the recess 22*a*.

It has been found that valve lifters constructed in accordance with the preferred embodiment of the invention have substantially improved life when used in competition engines of the type described above.

Although the invention has been described with a certain degree of particularity, it should be understood that those skilled in the art can make various changes to it without departing from the spirit or scope of the invention as hereinafter claimed.

I claim:

1. A valve lifter for an internal combustion engine, comprising:

1) a valve lifter body adapted to be reciprocally slidable within a valve lifter bore forming part of the internal combustion engine;

2) said valve lifter body rotatably mounting a cam roller engageable with a lobe of a cam forming part of said internal combustion engine, said cam lobe operative to drive said valve lifter body towards a valve opening position;

3) an auxiliary roller rotatably mounted within said valve lifter body and in rolling engagement with said cam roller wherein valve opening forces imparted to said cam roller by said cam lobe are transferred to said valve body by both said cam roller and said auxiliary roller.

2. The valve lifter of claim 1, wherein said cam roller is rotatably mounted on a first pin secured to said valve lifter body and said auxiliary roller is rotatably mounted to a second pin secured to said valve lifter body, such that the valve opening forces generated by said cam lobe are transferred from said rollers to said valve lifter body by said pins.

3. The valve lifter of claim 2, wherein said cam roller is rotatably supported on said first pin by an associated needle bearing and said auxiliary roller is rotatably supported on said second pin by an associated needle bearing.

4. The apparatus of claim 3, wherein said valve lifter body includes an ear which forms part of an anti-rotation mechanism which resists rotation of said valve lifter body within said valve lifter bore.

5. The valve lifter of claim 1 wherein said cam roller and said auxiliary roller are mounted in said lifter body in such a manner that the center of said cam roller and the center of said auxiliary roller are offset from one another.

6. A valve lifter for an internal combustion engine, comprising:

1. a valve lifter body adapted to be reciprocally slidable within a valve lifter bore forming part of the internal combustion engine;
2. said valve lifter body rotatably mounting a cam roller engageable with a lobe of a cam forming part of said internal combustion engine, said cam lobe operative to drive said valve lifter body towards a valve opening position;
3. an auxiliary roller rotatably mounted within said valve lifter body and in rolling engagement with said cam roller wherein valve opening forces imparted to said cam roller by said cam lobe are transferred to said valve body by both said cam roller and said auxiliary roller;
4. said lifter body containing a recess to house said cam roller and said auxiliary roller, said recess including grooves in the walls, said grooves exposing a plurality of bearings of said cam roller and said auxiliary roller to the grooves.

7. The valve lifter of claim 5, wherein said cam roller and said auxiliary roller are mounted in said lifter body in such a manner that the center of said cam roller and the center of said auxiliary roller are offset from one another.

8. A valve lifter for an internal combustion engine, comprising:

1) a valve lifter body adapted to be reciprocally slidable within a valve lifter bore forming part of the internal combustion engine including an ear which forms part of an anit-rotation mechanism which resists rotation of said valve lifter body within said lifter bore;
2) a recess located within said valve lifter body, said recess including bevels adapted to receive oil into the recess, said recess also including oiling grooves which provide a path for oil to travel within the recess for the purpose of lubricated the bearings of a cam roller and an auxiliary roller;
3) a cam roller positioned within said recess and rotatably mounted to the lifter body and in engagement with a lobe of a cam forming part of said internal combustion engine, wherein said cam roller is mounted to said lifter body on a first pin supported by a needle bearing, said cam lobe operates to drive said valve lifter body towards a valve opening position, and;
4) an auxiliary roller positioned within said recess and rotatably mounted to the lifter body by a second pin supported by a needle bearing and in rolling engagement with said cam roller, wherein valve opening forces imparted to said cam roller by said cam lobe are transferred to said valve body by both said cam roller and said auxiliary roller.

9. The valve lifter of claim 8, wherein said cam roller and said auxiliary roller are mounted in said lifter body such that the center of said cam roller and the center of said auxiliary roller are offset from one another.

10. A valve lifter for an internal combustion engine, comprising:

1) a valve lifter body adapted to be reciprocally slidable within a valve lifter bore forming part of the internal combustion engine; said valve lifter body comprising a recess, wherein said recess includes opposing internal wall portions each having lubricating grooves formed in the walls;
2) a cam roller rotatably mounted within said recess between said opposing wall portions engageable with a lobe of a cam forming part of said internal combustion engine, said cam lobe operative to drive said valve lifter body towards a valve opening position;
3) a roller mount extending through said cam roller for securing the cam roller to said lifter body between the opposing wall portions; and,
4) a plurality of bearing members rotatably supporting said roller about said roller mount, said bearing members arranged in a circular configuration and located between said roller mount and said cam roller, said wall portions and lubricating grooves configured such that at least portions of the ends of each member are engageable with respective wall portions at all times so that ends of said bearings cannot enter any of said lubricating grooves during lifter operation.

11. The valve lifter according to claim 10 wherein said grooves extend for the entire length of said recess.

12. A valve lifter for an internal combustion engine, comprising:

1) a valve lifter body adapted to be reciprocally slidable within a valve lifter bore forming part of the internal combustion engine; said valve lifter body comprising a recess, wherein lubricating grooves are formed in the walls of said recess, and
2) a cam roller rotatably mounted within said recess engageable with a lobe of a cam forming part of said internal combustion engine, said cam roller including a set of bearings, said cam lobe operative to drive said valve lifter body towards a valve opening position, and
3) an auxiliary roller rotatably mounted within said recess and in rolling engagement with said cam roller, said auxiliary roller including a set of bearings, wherein valve opening forces imparted to said cam roller by said cam lobe are transferred to said valve body by both said cam roller and said auxiliary roller.

13. The valve lifter according to claim 12 wherein a plurality of the bearings of the cam roller and the auxiliary roller are exposed to the grooves for lubrication purposes.

14. The valve lifter according to claim 12 wherein said bearings are needle bearings.

* * * * *